US008393877B2

(12) United States Patent
Metcalfe

(10) Patent No.: US 8,393,877 B2
(45) Date of Patent: Mar. 12, 2013

(54) PORTABLE LIQUID PUMP

(75) Inventor: Colin Metcalfe, Brunswick (AU)

(73) Assignee: Parchem Construction Supplies Pty Ltd, Sydney, NSW (AU)

( * ) Notice: Subject to any disclaimer, the term of this patent is extended or adjusted under 35 U.S.C. 154(b) by 351 days.

(21) Appl. No.: 12/739,049

(22) PCT Filed: Oct. 15, 2008

(86) PCT No.: PCT/AU2008/001527

§ 371 (c)(1),
(2), (4) Date: Sep. 24, 2010

(87) PCT Pub. No.: WO2009/052554

PCT Pub. Date: Apr. 30, 2009

(65) Prior Publication Data

US 2011/0008185 A1 Jan. 13, 2011

(30) Foreign Application Priority Data

Oct. 22, 2007 (AU) ..... 2007905781

(51) Int. Cl.
*F04B 53/00* (2006.01)
*F04B 17/05* (2006.01)
*F04B 35/06* (2006.01)

(52) U.S. Cl. ..... 417/234; 417/364; 417/423.9; 417/423.14

(58) Field of Classification Search ..... 417/234, 417/423.1, 423.14, 423.9, 364, 423.15; 415/121.1, 415/124.2, 206
See application file for complete search history.

(56) References Cited

U.S. PATENT DOCUMENTS

| | | | | |
|---|---|---|---|---|
| 898,499 | A | 9/1908 | O'Donnell | |
| 1,435,513 | A * | 11/1922 | Broadley et al. | 415/206 |
| 2,295,982 | A | 9/1942 | Widman | |
| 2,643,615 | A | 6/1953 | Murphy et al. | |
| 2,730,095 | A | 1/1956 | Scott | |
| 3,304,875 | A * | 2/1967 | Copeland | 417/423.14 |
| 3,308,764 | A | 3/1967 | Walker | |
| 3,785,752 | A | 1/1974 | Crespo | |
| 3,885,885 | A | 5/1975 | Cross, Jr. | |
| 4,211,002 | A | 7/1980 | Kirk | |
| 4,413,957 | A | 11/1983 | Sanders | |
| 4,556,364 | A * | 12/1985 | Barker | 415/172.1 |
| 4,588,353 | A | 5/1986 | Shibata et al. | |
| 4,934,914 | A | 6/1990 | Kobayashi et al. | |
| 5,148,992 | A | 9/1992 | Morrow | |
| 5,768,749 | A | 6/1998 | Ohi et al. | |
| 5,860,792 | A | 1/1999 | Marks | |
| 6,006,434 | A | 12/1999 | Templeton et al. | |
| 6,015,276 | A * | 1/2000 | Ponziani | 417/423.14 |
| 6,447,261 | B1 | 9/2002 | McCook | |
| 6,474,962 | B1 | 11/2002 | Allen et al. | |
| 6,494,674 | B1 * | 12/2002 | Cameron | 415/124.2 |
| 6,945,215 | B2 * | 9/2005 | Kawamoto et al. | 123/196 W |
| 7,382,104 | B2 | 6/2008 | Jacobson et al. | |
| 2005/0109307 | A1 * | 5/2005 | Kawamoto | 123/196 R |

(Continued)

*Primary Examiner* — Devon Kramer
*Assistant Examiner* — Bryan Lettman
(74) *Attorney, Agent, or Firm* — Richard M. Goldberg

(57) ABSTRACT

A portable hand held controllable and directable liquid pumping device including a vortex pump head (1) fitted to a first end (2) of an elongate flexible drive shaft (3) and a pump drive (4) fitted to a second end (5) of the flexible drive shaft in which the pump drive includes a substantially rigid elongate housing (6) for a portion of the drive shaft and the elongate housing includes a first handle (7) at or near the first end (8) remote from the pump drive.

20 Claims, 6 Drawing Sheets

U.S. PATENT DOCUMENTS

Figure 1:
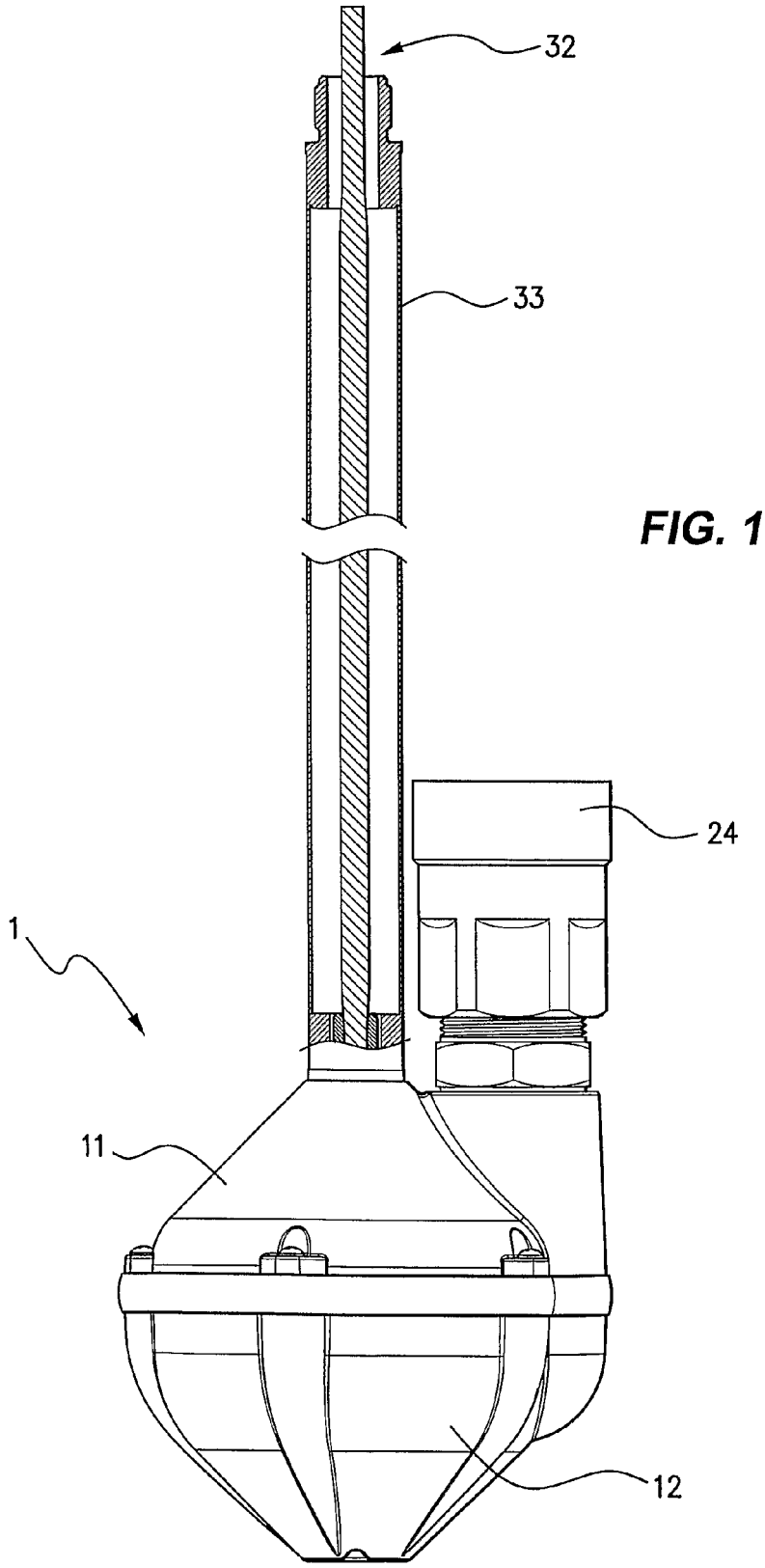

2005/0244287 A1 11/2005 Dobrynski
2006/0039800 A1 2/2006 Saunders
2007/0231159 A1 10/2007 Ruse et al.
2008/0189904 A1* 8/2008 Schliemann et al. ..... 15/344

* cited by examiner

PORTABLE LIQUID PUMP

CROSS-REFERENCE TO RELATED APPLICATIONS

The present application claims priority from Australian Provisional Patent Application No 2007905781 filed on 22 Oct. 2007, the content of which is incorporated herein by reference.

INTRODUCTION TO THE INVENTION

This invention relates to pumping devices for the purpose of transferring liquids and in particular, cleaning up and drawing excess liquids and liquid waste from confined or normally inaccessible environments for removal and disposal.

BACKGROUND TO THE INVENTION

The removal and handling of relatively small volumes of liquid waste and excess water from building sites including the removal of accumulated water from confined situations such as building footings and other such circumstances presents a unique problem to the building and construction industry. A wide range of heavy duty pumping devices and pumping systems are available for handling the removal and management of large quantities of water or alternatively, very small level pumping devices are also available for the movement and control of small liquid and water spills. However, such prior art pumping devices either involve the use of heavy cumbersome and expensive equipment for the removal of large quantities of water or alternatively, the smaller pumping devices have limitations on pickup depth. Of particular concern to the building industry is the ability to remove excess water and accumulated sludge that can build-up in newly constructed footings and excavation sites following rainfall or inadvertent spillage. The prior art pumping devices available either involve two or more man operations and furthermore, such large scale pumping devices are incapable of completely removing water and liquids in confined or normally inaccessible areas. Accordingly, the problem of concern to the building and construction industry includes the ability to rapidly and efficiently remove accumulated water from newly dug footings and excavations which may be subject to rainfall or other unexpected occurrences.

It will be desirable to provide a lightweight easily manoeuvrable one-person pumping device having the ability to flexibly and readily enter footings and other smaller parts of excavation sites with the ability to remove virtually all excess water from such situations.

Accordingly one object of the invention is to provide an improved pumping device.

STATEMENTS OF THE INVENTION

In a first aspect the invention provides a portable hand held, hand controllable and hand directable liquid pumping device comprising a vortex pump head fitted to a first end of an elongate flexible drive shaft and a pump driving means fitted to a second end of said flexible drive shaft wherein said pump driving means includes a substantially rigid elongate housing for a portion of said drive shaft and wherein said elongate housing includes a first handle means at or near the first end remote from said pump driving means.

The elongate housing may include a second handle means at or near the second end at said pump driving means. The second handle means may include an integral drive control means.

Preferably the elongate housing includes provision for a shoulder strap between the first and second handle means.

The pump head may include a volute generally tapering towards a volute inlet. The tapered volute faces may be separated by raised volute ribs to form a generally frustro conical shaped exterior face.

The volute inlet may be a generally circular orifice having an optional central dividing bridge in the form of a single or cruciform grid. The circumference of the volute orifice may be provided with two or more peripheral liquid inlet channels.

The pump head may include a manifold adapted to cooperate with the volute to form a vortex chamber and an impeller driven by the drive means and configured to rotate within the vortex chamber. The impeller is preferably positioned within the volute.

The volute may be provided with an interior strainer plate positioned to separate a preliminary inlet chamber from the vortex chamber.

The volute may include an outlet chamber for receiving fluid flow from said impeller.

The manifold may include an outlet chamber extension adapted to cooperate with the outlet chamber of the volute.

The pump head preferably includes a sacrificial wear plate positioned between the manifold and the volute to intercept the flow of liquid driven by the impeller. The wear plate includes an orifice allowing communication between the volute outlet chamber and the outlet chamber extension where the orifice may include a debris screen positioned thereover.

The strainer plate preferably includes an orifice generally sized and configured to align with the apical region of the impeller.

The drive means is preferably a four-stroke petrol engine.

In another aspect the invention provides a pump head for a portable hand held liquid pumping device comprising a manifold and a volute cooperating to form a vortex chamber and an impeller rotatable within said vortex chamber characterised in that said volute generally tapers towards a volute inlet.

The volute may include a plurality of generally tapered faces separated by raised volute ribs to form a generally frustro conical shaped exterior face.

The volute inlet preferably comprises an orifice bridged by dividing bridge in the form of a single or cruciform bridge. The volute may include an outlet chamber for receiving fluid flow from the impeller.

The pump head preferably includes a wear plate positioned between the volute and the manifold.

The manifold may include an outlet chamber extension in communication with the volute outlet chamber with a wear plate including an orifice allowing communication therein-between and a debris screen positioned over said orifice.

DETAILED DESCRIPTION OF THE INVENTION

Legend

1. Pump head
2. Drive shaft first end
3. Flexible drive shaft
4. Driving means
5. Drive shaft second end
6. Elongate housing
7. First handle means
8. Elongate housing first end
9. Second handle means (with integral drive control means)
10. Elongate housing second end
11. Manifold

Figure 2:
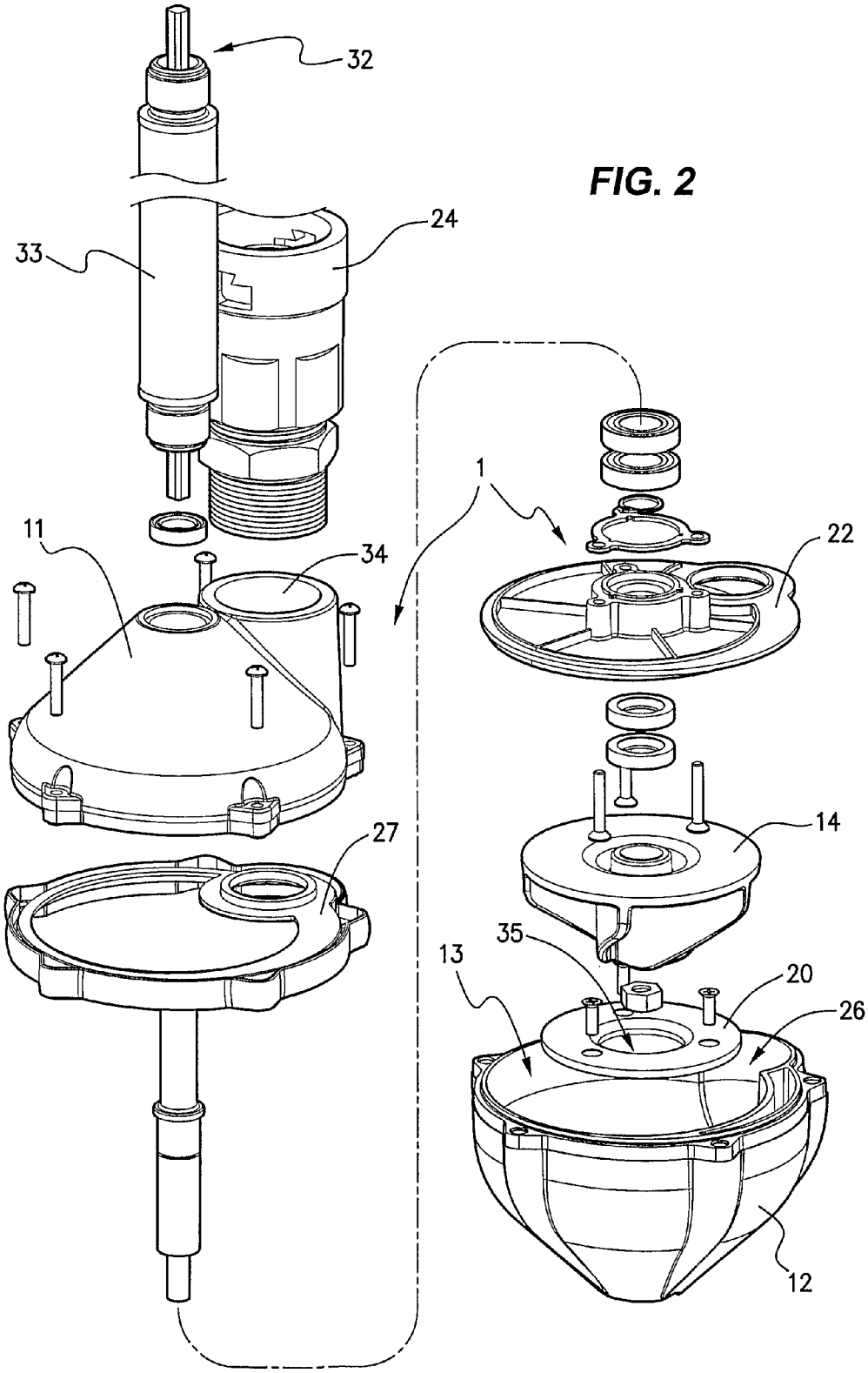
Figure 3:
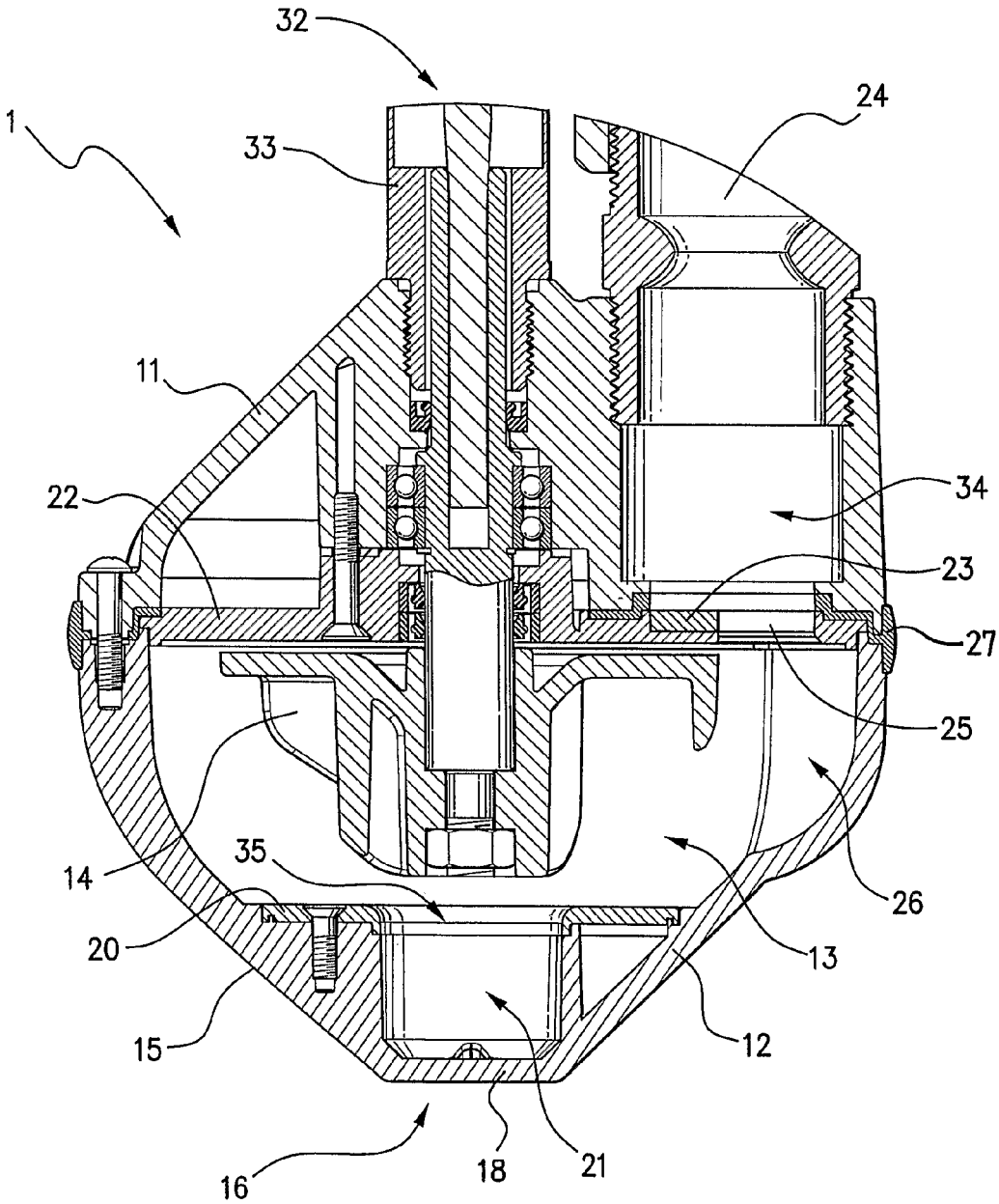
Figure 4:
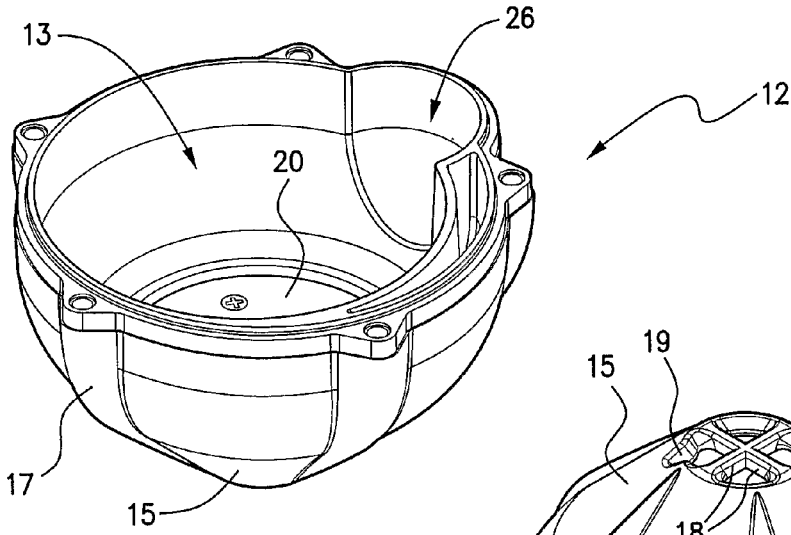
Figure 5:
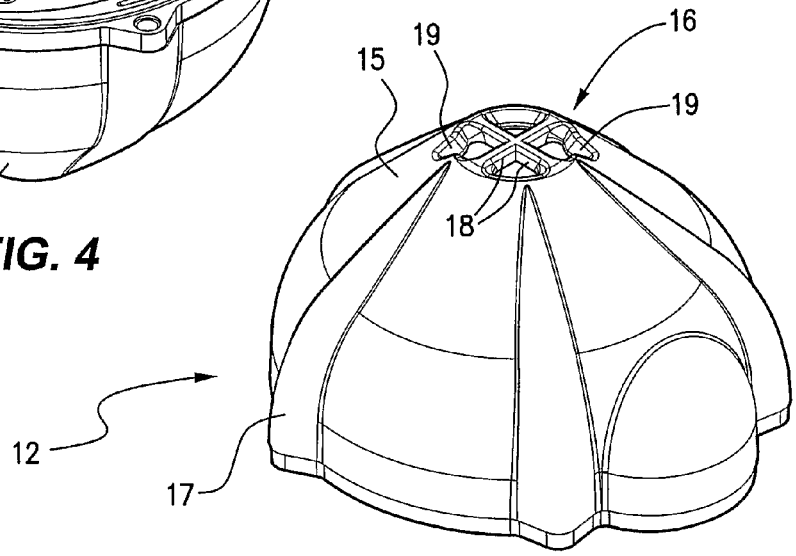
Figure 6:
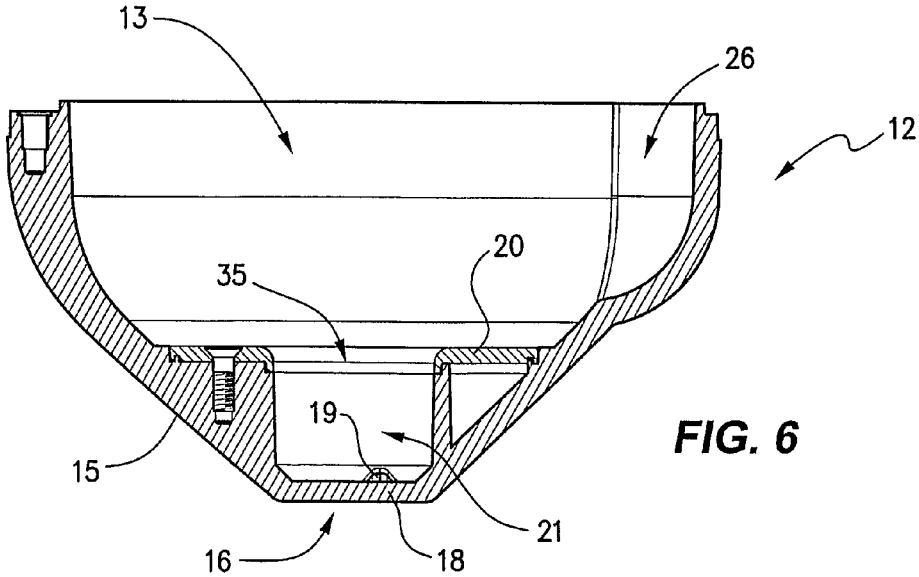
Figure 7:
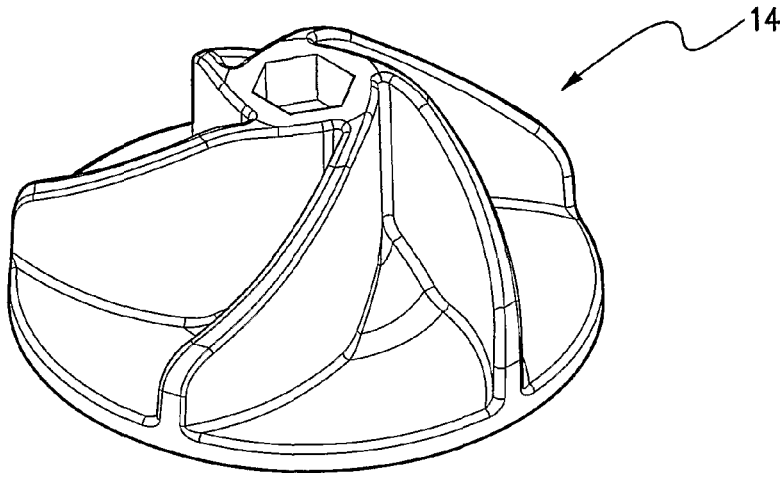
Figure 8:
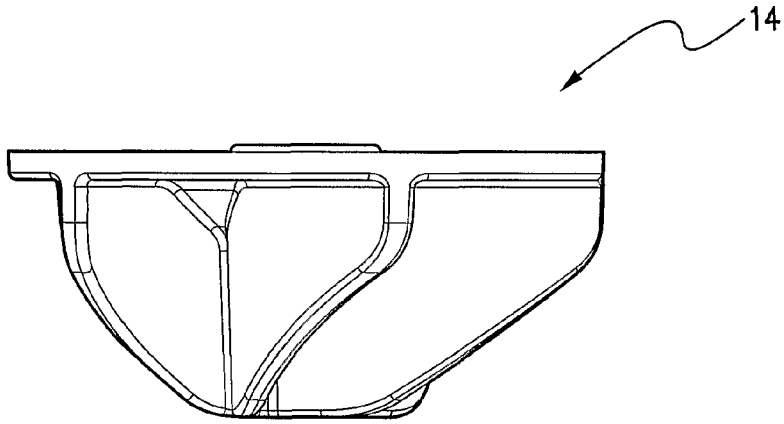
Figure 9:
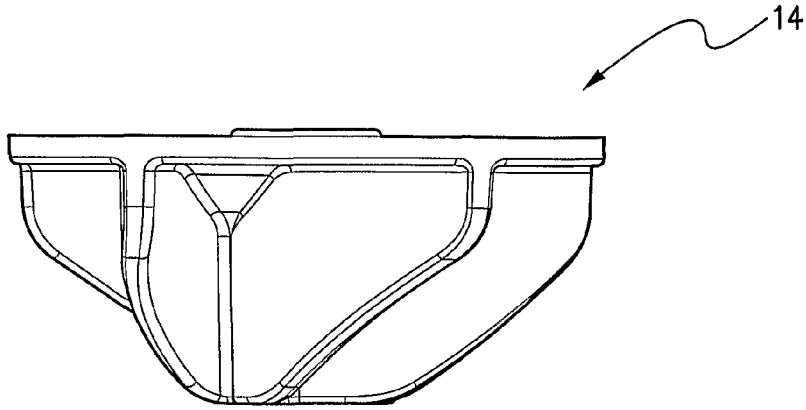
Figure 10:
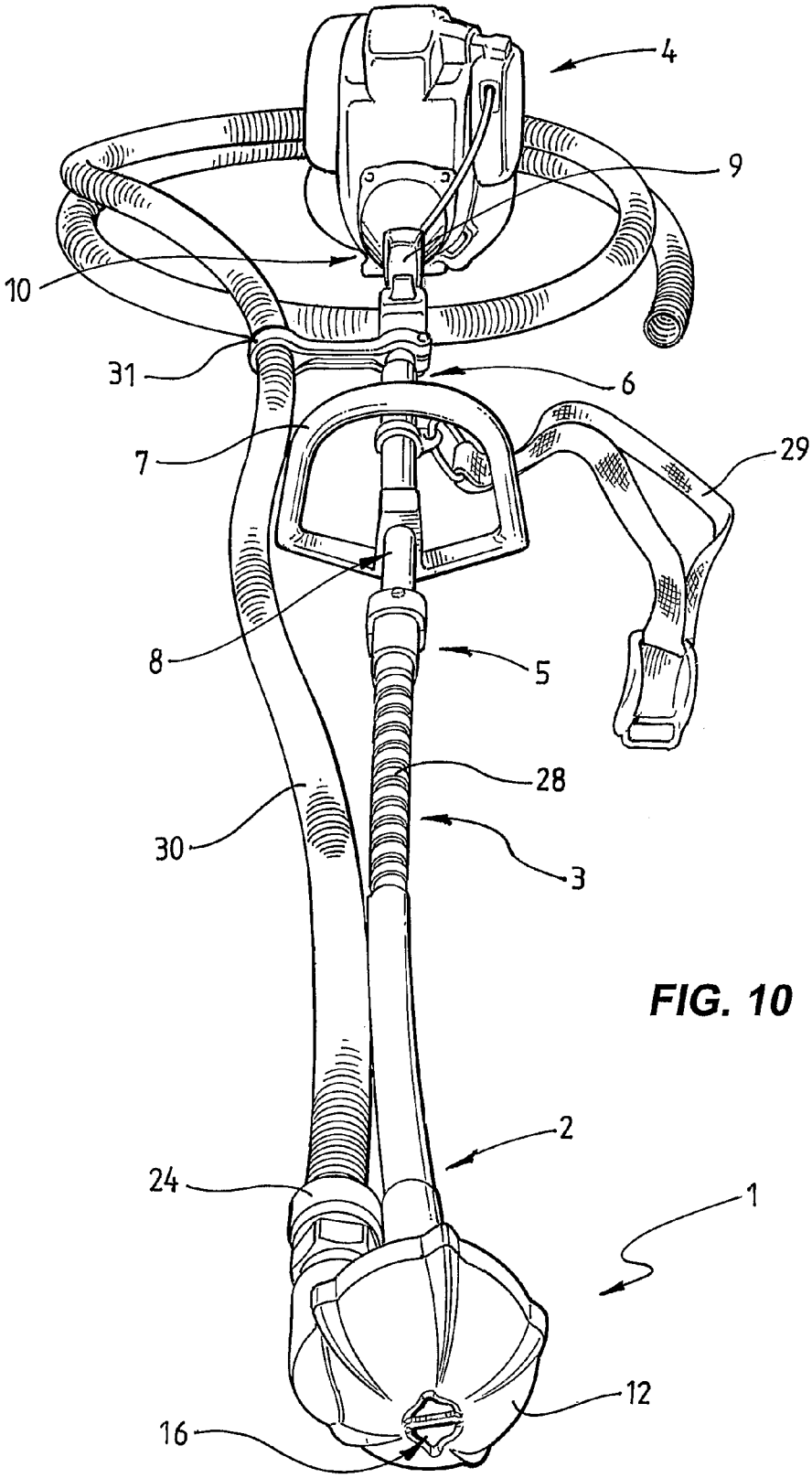

12. Volute
13. Vortex chamber
14. Impeller
15. Tapered faces
16. Volute inlet
17. Volute ribs
18. Dividing bridge
19. Peripheral channels
20. Strainer plate
21. Inlet chamber
22. Wear plate
23. Debris screen
24. Pump head outlet
25. Outlet aperture
26. Outlet chamber
27. Gasket
28. Flexible cover driveshaft
29. Shoulder strap means
30. Discharge tube
31. Discharge tube clip
32. Arbor
33. Arbor housing
34. Outlet chamber means
35. Strainer surface FIG. 1 shows a side view of the pump head;
FIG. 2 shows an exploded view of the pump head;
FIG. 3 shows a cross-section of the pump head;
FIG. 4 shows an inverted view of the pump volute;
FIG. 5 shows a bottom view of the pump volute;
FIG. 6 shows a cross-section of the pump volute;
FIG. 7 shows a perspective view of the impeller;
FIGS. 8 and 9 shows a side view of the impeller;
FIG. 10 shows an overall view of the pumping device.

Referring now to the Figures and the Legend, the most general form of the invention is shown in FIG. 10 where the portable handheld liquid pumping device of the invention is shown in its complete form being made up of a compact vortex type pump head 1, fitted to a first end 2 of an elongate flexible drive shaft 3, where the flexible drive shaft is powered at its second end 5 by a lightweight and portable pump driving means 4. The degree of flexibility can be changed by addition of a spring like flexible cover 28 that can be selected to impact suitable flexibility to the shaft.

In this particular embodiment of the invention, the pumping device utilises a high-powered four-stroke petrol engine of the type commonly found in other lightweight but powerful and portable handheld tools. The liquid pumping device of the invention utilises the manoeuvrability and lightweight features of a high-powered four-stroke petrol engine as a drive means 4, and includes a rigid elongate output drive housing 6 extending from the drive means with a first handle means 7 positioned at a first end 8 of the elongate drive housing and a second handle means 9 positioned near the drive means positioned at a second end 10 of the same elongate drive housing which may include an integral throttle and/or other control means. In addition, the housing includes provision for a shoulder strap 29 between the first and second handle means to balance the device and assist in manoeuvrability. In this manner, the drive means of the pumping device of the invention utilises the manoeuvrability, portability and tight control available from light weight and powerful petrol engines which is then applied and utilised with the pumping device of the invention by the fitting to the first end 8 of the elongate drive housing 6 the flexible drive shaft 3 of the pumping device of the invention. With these features, the operator is able to maintain full and complete control of the drive means 4 by way of the handle 7 and where appropriate, an associated shoulder strap or harness 29 such that in the standing position the operator is able to manipulate the drive means where the first end 8 of the drive means is fitted with the flexible drive shaft 3 which allows the pump head 1 to be driven by virtue of the flexible drive shaft whilst allowing a high degree of flexibility and manoeuvrability of the pump head into tight, confined and otherwise inaccessible situations. The pump head 1 is of the vortex type thereby allowing the pump head to draw liquid along where the degree of contamination and debris, and also enjoy the capability of drawing liquid along with a mixture of air and other challenging pumping scenarios. The pump head 1 is provided with a flexible discharge tube 30 fitted to the pump outlet 24 where the discharge tube can be conveniently clipped or held in relationship to the flexible drive shaft and elongate housing 6 by way of a clip 31. The separation of the pumped liquid and the drive shaft minimises any potential damage to the working parts of the device past the impeller. In operation, the portable handheld liquid pumping device of the invention can be conveniently harnessed to a user with the extended flexible drive shaft 3 allowing full manoeuvrability and positioning of the pump head 1 into small excavations including building footings etc which would otherwise be inaccessible to larger pumping devices and equally inaccessible to the small pumping devices currently available. The pump head ensures that substantially all liquid can be drawn up through the pump outlet and discharge tube for convenient disposal, in a one person, efficient and economical manner.

The pump head of the invention will now be explained and described in more detail with reference to FIGS. 1, 2, 3 and 10.

Referring now to those figures, the pump head 1 is fitted with an arbor 32 being adapted for receiving the first end 2 of the flexible drive shaft 3 so as to transmit torque of the drive means of the device to the pump head 1. The arbor is presented through a rigid arbor housing 33. The arbor housing can be elongate as shown in FIG. 1, or alternatively and preferably, of shorter length as indicated in FIG. 3.

The vortex type pump head includes a manifold 11 fitted to the arbor housing 33 and an opposing pump volute 12 which cooperates with the manifold where the manifold and pump volute are adapted for co-engagement so as to create or form a vortex chamber 13 thereinbetween. Positioned within the vortex chamber and driven by the arbor 32 is an impeller 14 adapted for rotational movement subject to operation of the drive means. The rotation of the impeller within the vortex chamber creates a vacuum which effects the primary pumping operation. The pump volute is specifically configured to include a plurality of substantially flat tapered exterior faces 15 leading toward a centralised volute inlet 16 shown most clearly in FIG. 3. The tapered volute faces are configured to form segments of a generally frustro conical shaped face separated by raised volute ribs 17 as shown in FIGS. 4 and 5. The configuration of the pump volute allows full advantage of the flexibility provided by the flexible drive shaft such that the volute inlet 16 can be very accurately and intimately engaged to small and highly confined spaces so as to achieve a virtually complete withdrawal of all liquids in most circumstances.

Referring to FIGS. 3 and 5, the volute inlet 16 is a generally circular shaped orifice having an optional central dividing bridge 18 which can be cruciform in shape. The dividing bridge serves the purposes of a first rough filtration to eliminate the drawing up of large pieces of debris which may interfere or damage the impeller or get jammed within the subsequent internals of the pump head. In order to maximise the capacity of the volute inlet, and minimise blockages, the circumference of the volute inlet or orifice may be provided with one or more indents or channels 19 which allow the pump to function in the event of substantial blockage around the bridge region.

Referring now to FIGS. 2, 3, 4 and 6, the pump volute may be provided with an internal strainer plate 20 positioned relative to the inlet 16 and thereby creating an inlet chamber 21. The strainer plate 20 serves a purpose of straining and preventing the pump drawing up larger pieces of debris into the vortex chamber 13 and thereby further minimise any damage to the impeller or the drawing up of inappropriate debris.

The strainer plate includes a central orifice generally sized to cooperate with the apex of the impeller.

The pump head incorporates an impeller 14 driven from the arbor 32 with the impeller being positioned within the vortex chamber 13. The position between the impeller and the manifold 11 is provided with a sacrificial wear plate 22. The wear plate is provided to receive the bulk impact of the smaller debris particle drawn through the vortex chamber along with the normal wear and tear associated with the high velocity movement of liquids and debris through the vortex chamber during normal operation of the pump. The wear plate may also be configured to assist in the directing and movement of liquid flow through the pump to the outlet 24. The compact nature of the pump head is augmented with an outwardly projecting outlet chamber 26 which assists in the accumulation of liquid being drawn through the pump prior to dispatch through the outlet aperture 25 and then to the outlet 24. The manifold also includes an outlet chamber 34 as an extension of the volute outlet chamber.

In order to minimise any potential damage or jamming of smaller debris that may have entered the pump vortex chamber 13, the wear plate 22 may be provided with a debris protection screen 23 partially covering the outlet chamber 26 so as to protect the full extent of the impeller as it extends into or over the outlet chamber 26. The provision of the debris protection screen ensures that smaller sized debris are prevented or discouraged from jamming between the impeller and the wear plate 22 thereby ensuring maximum efficiency and smooth operation of the pump.

The pump head components of the manifold and the volute 12 may be separated and sealed by way of a dedicated gasket 27 positioned thereinbetween such that during assembly the manifold and volute can be snugly fitted together with the gasket ensuring a sealed vortex chamber within the confines of the pump head 1.

The outlet of the pump 24 may be fitted with any one of a number of bayonette or snap-lock fittings for attachment of the discharge tube 30.

The specific and preferred configuration of the impeller is shown in FIGS. 7 through to 9, where the design of the impeller as shown has been provided to ensure maximum efficiency and operation of the pump without overloading the drive means or alternatively, without placing undue strain on the impeller and flexible drive shaft in the event that the drive means is overpowered.

In use, the handheld liquid pumping device of the invention provides for the first time a one-person, highly efficient, low volume pumping device specifically adapted for use in the construction industry and other situations where smaller levels and quantities of liquid including water and the like may require removal from small excavations including footings etc., which can inadvertently become filled or compromised by rain and other sources of water. The pumping device of the invention allows a single operator to fully control and move the pump through such compact and confined environments drawing water down to very low levels and virtually eliminating build-up of water in small corners and orifices otherwise quite inaccessible to the currently available larger pumping systems and equally beyond the scope of the smaller scale pumping devices available.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A portable hand held, hand controllable and hand directable liquid pumping device comprising:

an elongate flexible drive shaft, a vortex pump head fitted to a first end of the elongate flexible drive shaft, said pump head including a volute tapering toward a volute inlet and said volute inlet including an orifice bridged by a dividing bridge, and said volute orifice including at least one peripheral channel, and a pump drive fitted to a second end of said flexible drive shaft wherein said pump drive includes a rigid elongate housing for a portion of said drive shaft and wherein said elongate housing includes a first handle at least neat a first end proximate the second end of the flexible drive shaft.

2. The pumping device according to claim 1, wherein said elongate housing includes a second handle positioned at least near a second end at said pump drive remote from said second end of said flexible drive shaft.

3. The pumping device according to claim 2, wherein said elongate housing includes a provision for a shoulder strap between said first and second handles.

4. The pumping device according to claim 1, where said volute includes a plurality of tapered faces separated by raised volute ribs to form a frustro conical shaped exterior face.

5. The pumping device according to claim 1, wherein said pump head includes a manifold adapted to cooperate with said volute to form a vortex chamber and an impeller driven by said pump drive and configured to rotate within said vortex chamber.

6. The pumping device according to claim 5, wherein said impeller is positioned within said volute.

7. The pumping device according to claim 1, wherein said pump drive is a four stroke petrol engine.

8. A portable hand held, hand controllable and hand directable liquid pumping device pumping device comprising:

an elongate flexible drive shaft, a vortex pump head fitted to a first end of the elongate flexible drive shaft, said pump head including a volute tapering toward a volute inlet, and a pump drive fitted to a second end of said flexible drive shaft wherein said pump drive includes a rigid elongate housing for a portion of said drive shaft and wherein said elongate housing includes a first handle at least near a first end proximate the second end of the flexible drive shaft, wherein said pump head includes a manifold adapted to cooperate with said volute to form a vortex chamber and an impeller driven by said pump drive and configured to rotate within said vortex chamber, and said pump head includes a wear plate positioned between said volute and said manifold.

9. The pumping device according to claim 8, wherein said volute inlet comprises an orifice bridged by a dividing bridge.

10. The pumping device according to claim 9, wherein said dividing bridge is a cruciform.

11. The pumping device according to claim 8, wherein said volute includes an outlet chamber for receiving fluid flow from said impeller.

12. The pumping device according to claim 11, wherein said pump head includes a manifold adapted to cooperate with said volute to form a vortex chamber and said manifold includes an outlet chamber extension in communication with said volute outlet chamber.

13. A portable hand held, hand controllable and hand directable liquid pumping device comprising:

an elongate flexible drive shaft, a vortex pump head fitted to a first end of the elongate flexible drive shaft, said pump head including a volute tapering toward a volute inlet, and said volute includes an outlet chamber for receiving fluid flow from said impeller, and a pump drive fitted to a second end of said flexible drive shaft wherein said pump drive includes a rigid elongate housing for a portion of said drive shaft and wherein said elongate housing includes a first handle at least near a first end proximate the second end of the flexible drive shaft, wherein said pump head includes a manifold adapted to cooperate with said volute to form a vortex chamber, and said manifold includes an outlet chamber extension in communication with said volute outlet chamber, and wherein said pump head includes a wear plate positioned between said volute and said manifold and said wear plate includes an orifice allowing communication between said volute outlet chamber and said outlet chamber extension, and a debris screen positioned over said orifice.

14. A portable hand held, hand controllable and hand directable liquid pumping device pumping device comprising:

an elongate flexible drive shaft, a vortex pump head fitted to a first end of the elongate flexible drive shaft, said pump head including a volute tapering toward a volute inlet, and a pump drive fitted to a second end of said flexible drive shaft wherein said pump drive includes a rigid elongate housing for a portion of said drive shaft and wherein said elongate housing includes a first handle at least near a first end proximate the second end of the flexible drive shaft, wherein said pump head includes a manifold adapted to cooperate with said volute to form a vortex chamber and an impeller driven by said pump drive and configured to rotate within said vortex chamber, and wherein said volute includes an inlet chamber positioned between said volute inlet and said impeller wherein said inlet chamber is provided with a strainer.

15. The pumping device according to claim 14, wherein said strainer includes an orifice generally sized to be aligned with an apex of said impeller.

16. A pump head comprising:

a manifold and a volute cooperating to form a vortex chamber, and an impeller rotatable within said vortex chamber, wherein said volute tapers toward a volute inlet, wherein said volute includes an outlet chamber for receiving fluid flow from said impeller, wherein said manifold includes an outlet chamber extension in communication with said volute outlet chamber, and further including a wear plate positioned between said volute and said manifold and wherein said wear plate includes an orifice allowing communication between said volute outlet chamber and said outlet chamber extension, and a debris screen positioned over said orifice.

17. The pump head according to claim 16, wherein said volute includes a plurality of tapered faces separated by raised volute ribs to form a frusto conical shaped exterior face.

18. The pump head according to claim 16, wherein said volute inlet comprises an orifice bridged by a dividing bridge.

19. The pump head according to claim 18, wherein said dividing bridge is a cruciform.

20. The pump head according to claim 16, further including a wear plate positioned between said volute and said manifold.

* * * * *